United States Patent [19]

Sullivan

[11] 4,432,308

[45] Feb. 21, 1984

[54] FUEL FOR COMBUSTION ENGINES

[75] Inventor: Peter J. Sullivan, Fort Wayne, Ind.

[73] Assignee: Erad Inc., Fort Wayne, Ind.

[21] Appl. No.: 210,143

[22] Filed: Nov. 24, 1980

Related U.S. Application Data

[62] Division of Ser. No. 809,913, Jun. 24, 1977.

[51] Int. Cl.[3] ..... F02M 25/00; F02B 75/12

[52] U.S. Cl. ..... 123/1 A; 44/77; 44/56; 123/25 R; 123/198 A

[58] Field of Search ..... 44/77, 50, 56; 123/1 A, 123/25 E, 25 R, 198 A

[56] References Cited

FOREIGN PATENT DOCUMENTS 156594 3/1922 United Kingdom ..... 44/77

156694 4/1922 United Kingdom ..... 44/77

OTHER PUBLICATIONS

Remler, "The Use of Acetone in Composite Engine-Fuels" Journ. of the Soc. Of Automotive Engineers, vol. XIII, No. 1, Jul. 1923, pp. 23 & 24.

Lange, "Handbook of Chemistry", Revised 10th Edition, pp. 406–407, 1967.

Maccardle, "The Use of Solvents in Synthetic Organic Chemistry" Published by D. Van Nostrand Co., N.Y., N.Y., 1925, pp. 103, 104, and 186 (Bibliography).

*Primary Examiner*—Charles F. Warren

*Assistant Examiner*—Y. Harris-Smith

*Attorney, Agent, or Firm*—Charles S. Penfold

[57] ABSTRACT

The subject invention involves providing a novel fluid or liquid fuel for combustion engines.

6 Claims, No Drawings

FUEL FOR COMBUSTION ENGINES

BACKGROUND

This application is a division of my application Ser. No. 809,913 filed June 24, 1977.

It is recognized that there are a multitude of various kinds of fuel available for combustion engines, such as, for example, diesel, modified forms of gasoline, alcohol, hydrogen and methane.

Also, in view of what is presently termed an "energy crisis", it is recognized that certain oil companies, Government agencies and individuals are expending appreciable amounts of time, money in equipment, technology, development and experimentation with a view to obtaining different kinds of fuel which may be utilized in automotive vehicles in order to avoid substantial reliance on the importation of crude oils from abroad.

An investigation also shows that there are a multitude of Patents which are directed to the use of acetone in combination with other ingredients or chemicals for use as a fuel.

OBJECTIVES

With the foregoing in mind, the primary object of the subject invention is to provide an improved liquid or fluid fuel or solution which comprises a combination of acetone and water. This combination does not appear to be present in any of the Patents obtained as a result of the investigation alluded to above.

A significant objective of the invention is to provide an improved fuel which is appreciably less expensive to produce than those fuels now being utilized. Otherwise expressed, the cost of processing or producing the improved fuel is relatively simple and minimal as compared to the cost of cracking or refining crude oil to obtain the various grades of gasoline which are presently on the market.

Other attributes of the invention reside in providing a fuel which is substantially non-pollutive, non-toxic or irritating and leaves no offensive odors during combustion and its elements or ingredients are readily mixable and available.

Additional objects and advantages of the invention will become apparent after the description hereinafter set forth is considered.

DESCRIPTION

The subject invention as generally described above preferably comprises a solution of acetone and water in predetermined amounts or percentages which are adequate to provide proper combustion.

The formula for acetone is $CH_3COCH_3$ and of course water is $H_2O$.

The acetone and water can be combined in variable proportions, percentages, or quantities.

For example, tests have proven that a mixture or solution comprising a range of between 25% acetone and 75% water by volume or a solution of 75% acetone and 25% water are satisfactory for operating certain engines. These percentages depend on the compression ratio of the engines. More particularly, a solution comprising 25% acetone and 75% water will, for example, operate an engine having a compression ratio of around 13:1 and a solution comprising 75% acetone and 25% water will successfully operate an engine having a compression ratio around 6:1.

It has also been proven that a solution of about 60% acetone and 40% water will operate an engine having a compression ratio of around 9:1; that a solution of about 50% acetone and 50% water will operate an engine having a compression ratio of about 8:1, and that a solution of about 40% water and 60% acetone will operate an engine having a compression ratio of around 7:1.

Tests have also proven that the fuel can be utilized in a tank of a conventional automotive vehicle, in which event, it is desirable that the size of the jet apertures in the carburetor be increased. If an auxiliary tank is provided for the fuel it is desirable that an adjustable valve be associated with the carburetor for conversion purposes for controlling the admission or flow of the fuel thereto. In other words, if a tank of gasoline has been depleted the engine can be supplied with the improved fuel by correctly adjusting the valve or the improved fuel may be utilized prior to that of the gasoline.

In order to remove any possible foreign matter from the acetone and water it is desirable that they be filtered separately or as a mixture prior to actual use or if they are pure, filtering is not essential. Tests have further proven that the fuel may be stored for several months prior to use without any deteriorating effects.

The invention particularly involves providing a method for operating an internal combustion engine, comprising burning in said engine a mixture consisting of acetone and water in which said mixture contains from 25% to 75% by volume of acetone.

Having thus described my invention, it is obvious that various modifications may be made in the same without departing from the spirit of the invention and, therefore, I do not wish to be understood as limiting myself to the exact percentages of the incredients utilized.

I claim:

1. A method for operating an internal combustion engine, comprising burning in said engine a mixture consisting of acetone and water in which said mixture contains from 25% to 75% by volume of acetone.

2. The method of claim 1, in which said mixture contains 25% by volume of acetone.

3. The method of claim 1, in which said mixture contains about 50% by volume of acetone.

4. The method of claim 1, in which said mixture contains about 40% by volume of acetone.

5. The method of claim 1, in which said mixture contains about 60% by volume of acetone.

6. The method of claim 1, in which said mixture contains 75% by volume of acetone.

* * * * *